US009430931B1

(12) United States Patent
Liu et al.

(10) Patent No.: US 9,430,931 B1
(45) Date of Patent: Aug. 30, 2016

(54) DETERMINING USER LOCATION WITH REMOTE CONTROLLER

(71) Applicant: Amazon Technologies, Inc., Seattle, WA (US)

(72) Inventors: Yue Liu, Milpitas, CA (US); Robert Warren Sjoberg, San Francisco, CA (US); Robert Ramsey Flenniken, Burlingame, CA (US); Ramy Sammy Sadek, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 16 days.

(21) Appl. No.: 14/308,601

(22) Filed: Jun. 18, 2014

(51) Int. Cl.
*G08B 21/24* (2006.01)

(52) U.S. Cl.
CPC ..... *G08B 21/24* (2013.01)

(58) Field of Classification Search
None
See application file for complete search history.

(56) References Cited

U.S. PATENT DOCUMENTS

| | | | | |
|---|---|---|---|---|
| 7,418,392 | B1 | 8/2008 | Mozer et al. | |
| 7,720,683 | B1 | 5/2010 | Vermeulen et al. | |
| 7,774,204 | B2 | 8/2010 | Mozer et al. | |
| 2006/0069503 | A1* | 3/2006 | Suomela | H04M 1/72572 701/431 |
| 2010/0225461 | A1* | 9/2010 | Tuli | G01S 3/8036 340/436 |
| 2011/0063429 | A1* | 3/2011 | Contolini | A61B 17/00 348/77 |
| 2012/0223885 | A1 | 9/2012 | Perez | |
| 2012/0263020 | A1* | 10/2012 | Taylor | G01S 5/18 367/124 |

FOREIGN PATENT DOCUMENTS

WO WO2011088053 A2 7/2011

OTHER PUBLICATIONS

Pinhanez, "The Everywhere Displays Projector: A Device to Create Ubiquitous Graphical Interfaces", IBM Thomas Watson Research Center, Ubicomp 2001, Sep. 30-Oct. 2, 2001, 18 pages.

* cited by examiner

*Primary Examiner* — Daniell L Negron
(74) *Attorney, Agent, or Firm* — Lee & Hayes, PLLC

(57) ABSTRACT

An audio device may be configured to work in conjunction with a handheld remote controller to receive voice commands from a user. The audio device may have multiple local microphones that are used for sound source localization, to determine the position of the user. A remote audio signal may be received from the remote controller and used in conjunction with local microphone signals generated by the local microphones to aid in determining the position of the user. The last known position of the user may be recorded whenever the user speaks into the remote controller. When the user is unable to find the remote controller, the audio device may direct the user toward the last known position of the user.

23 Claims, 4 Drawing Sheets

DETERMINING USER LOCATION WITH REMOTE CONTROLLER

BACKGROUND

As the processing power available to devices and associated support services continues to increase, it has become practical to interact with users in new ways. In some cases, user interactions are based on positions of users relative to an interface device. User positions can be determined using sound source localization techniques that utilize audio beamforming and other audio processing technologies.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Figure 1:
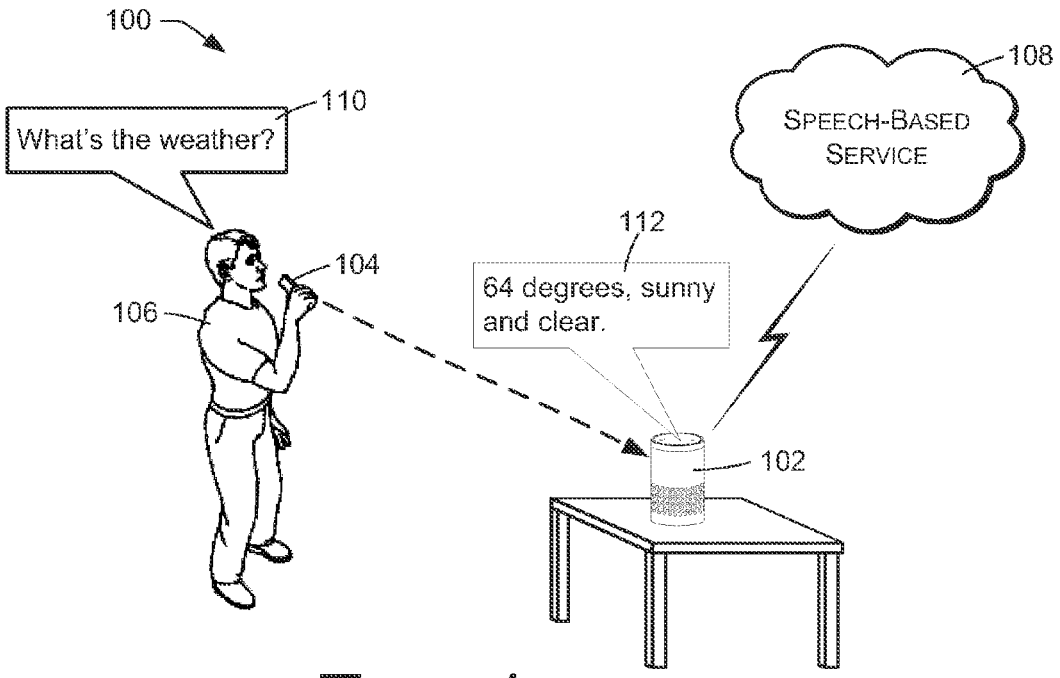
FIG. 1 shows an illustrative speech-based system that includes a base device, a remote controller, and a cloud-based speech service.

A speech-based system may be configured to interact with a user through speech to receive instructions from the user and to provide services for the user. The system may have a base device with a speaker and a local microphone array. The speaker is used to produce machine-generated speech when interacting with the user. The speaker may also be used to produce other audio such as music. The local microphone array is used to capture user utterances, which may be analyzed using speech recognition and natural language understanding techniques to determine user intents expressed by the user utterances.

The base device may be capable of audio beamforming and/or sound source localization based on local audio signals received from the individual microphone elements of the local microphone array. Audio beamforming may be used, for example, to produce a directional audio signal corresponding to the direction of the user relative to the base device, in order to obtain a better representation of the user's speech. Sound source localization may be used to determine the direction or position of the user or other sources of sound. Both audio beamforming and sound source localization may be implemented based on the differences in arrival times of sound at the different elements of the local microphone array, using what are referred to as time-difference-of-arrival (TDOA) techniques.

The speech-based system may include a remote controller that works in conjunction with the base device. The remote controller may have a microphone into which the user may speak. The remote controller captures the user speech and transmits a remote audio signal containing the user speech to the base device using a personal-area network (PAN) communications protocol such as Bluetooth®. Because the remote controller may be held close to the user's mouth, the remote audio signal may contain a relatively clear representation of the user's speech.

The base device is configured to receive the remote audio signal from the remote controller and to use the remote audio signal as a reference when performing sound source localization.

In one embodiment, the base device may perform audio beamforming based on its local audio signals to produce multiple directional audio signals, each of which emphasizes sound from a corresponding different direction. The remote audio signal received from the remote controller, which contains a relatively accurate representation of the user's speech, is then compared to each of the directional audio signals to determine which of the directional audio signals has the strongest presence of the user speech. The direction corresponding to this directional audio signal corresponds to the direction of the user relative to the base device.

The distance of the user from the base device may be determined by comparing the strength of the user's voice at the remote controller with the strength of the user's voice at the base device, such as by comparing the strength of user speech in the reference audio signal to the strength of user speech in the directional audio signal corresponding to the direction of the user. Such a comparison may be based on known characteristics or calibrations of the base device microphones and the remote controller microphone.

In another embodiment, the remote audio signal received from the remote controller may be used to identify user speech in the local audio signals generated by the multiple microphone elements of the base device's microphone array. After identifying user speech in the audio signals generated by the microphone array, time-difference-of-arrival (TDOA) techniques may be used to determine the position of the user relative to the microphone array.

In certain embodiments, the system may determine the position of the user each time the user speaks into the remote controller and may record the position of the user. The position of the user at the time the remote controller was last used may be considered and recorded as the last known location of the remote controller. In the case that the user at some point does not know where the remote controller is, the system may inform the user regarding the last known location of the remote controller. For example, the system may guide the user verbally toward the remote controller or may provide a visual indication of the direction of the controller relative to the base device. As another example, the system may identify the location of the remote controller relative to known landmarks or features such as articles of furniture, appliances, room corners, etc., the positions of which have been registered in a previous calibration or initialization procedure.

FIG. 1 shows an example of a speech-based system 100 having a base device 102 and a remote controller 104. The speech-based system 100 may be implemented within an environment such as a room or an office, and a user 106 is shown as interacting with the speech-based system 100.

Although only one user 106 is illustrated in FIG. 1, multiple users may use the voice controlled system 100.

The base device 102 may in some embodiments comprise a network-based or network-accessible speech interface device having a microphone, a speaker, and a network interface or other communications interface. The remote controller 104 may comprise a handheld device that is held by the user at a variable position relative to the base device 102.

The remote controller may be configured to communicate with the base device 102 using a personal-area network (PAN) such as Bluetooth®. The remote controller 104 may have media control buttons and may also have a microphone into which a user can speak in order to issue spoken commands to the system 100. In some cases, the remote controller 104 may have a push-to-talk button that the user 106 pushes when speaking.

The speech-based system 100 may include a speech-based service 108 that receives real-time audio or speech information from the base device 102 in order to detect user utterances, to determine user intent based on the utterances, and/or to perform actions or provide services in fulfillment of the user intent. The speech-based service 108 may also generate and provide speech and other audio for playback by the base device 102. In some cases, the speech-based service 108 may conduct speech dialogs with the user 106 using the microphone and speaker capabilities of the base device 102. A speech dialog may comprise an alternating sequence of user utterances and system speech responses.

The speech-based service 108 may in some embodiments be implemented as a network-based or cloud-based service. Communications between the base device 102 and the service 108 may be implemented through various types of data communications networks, including local-area networks, wide-area networks, and/or the public Internet. Cellular and/or other wireless data communications technologies may also be used for communications. The speech-based service 108 may serve a large number of base devices, which may be located in the premises of many different users.

The speech-based service 108 is configured to interact with the user 106 through the base device 102 to determine a user intent and to provide a function or service in response to or in fulfillment of the user intent. Provided services may include performing actions or activities, rendering media, obtaining and/or providing information, providing information via generated or synthesized speech via the base device 102, initiating Internet-based services on behalf of the user 106, and so forth.

In FIG. 1, the user 104 is shown communicating with the speech-based service 108 by speaking into the microphone of the remote controller 104. In this example, the user is asking an audible question, "What's the weather?", as represented by the dialog bubble 110. Alternatively, the user 106 may speak in the direction toward the base device 102 without using the remote controller 104. The speech-based service 108 may respond to input from either the remote controller 104 or the base device 102. When using the remote controller 104 for speech input, the user may in some cases be required to press a push-to-talk button on the remote controller 104 to indicate that he or she is making an utterance that is intended to be recognized and interpreted as a system query or command.

In response to the spoken query, the system 100 may respond with generated speech as indicated by the dialog bubble 112. The response may be generated by the base device 102. In this example, the response indicates, in response to the user's query, that the weather is "64 degrees, sunny and clear."

Functionally, one or more audio streams may be provided from the base device 102 and/or the remote controller 104 to the speech-based service 108. The provided audio streams may be processed by the speech-based service 108 in various ways to determine the meaning of the user's query and/or the intent expressed by the query. For example, the speech-based service 108 may implement automated speech recognition (ASR) to obtain a textual representation of user speech that occurs within the audio. The ASR may be followed by natural language understanding (NLU) to determine the intent of the user 106. The speech-based service 108 may also have command execution functionality to compose and/or implement commands in fulfillment of determined user intent. Such commands may be performed by the speech-based service 108 either independently or in conjunction with the base device 102, such as by generating audio that is subsequently rendered by the base device 102. In some cases, the speech-based service 108 may generate a speech response, which may be sent to and rendered by the base device 102.

In addition to acting as a speech interface, the base device 102 may provide other types of capabilities and functionality for the benefit of the user 106. For example, the base device 102 may act as a media device for playing music, video, or other content.

As will be described in more detail, the base device 102 may have sound source localization (SSL) functionality for determining the position of the user 106. The SSL functionality may utilize a remote audio signal provided by the remote controller 104 as a reference to identify user speech in local microphone signals.

In some embodiments, the system 100 may be configured to determine and record positional information regarding the user 106 whenever the user speaks into the remote controller 104, and may use the positional information as an indication of the last known location of the remote controller 104. In a situation where the user 106 is unable to locate the remote controller 104 or forgets the location of the remote controller 104, the system 100 may guide the user 106 to the last known location of the remote controller 104, based on the recorded positional information.

Figure 2:
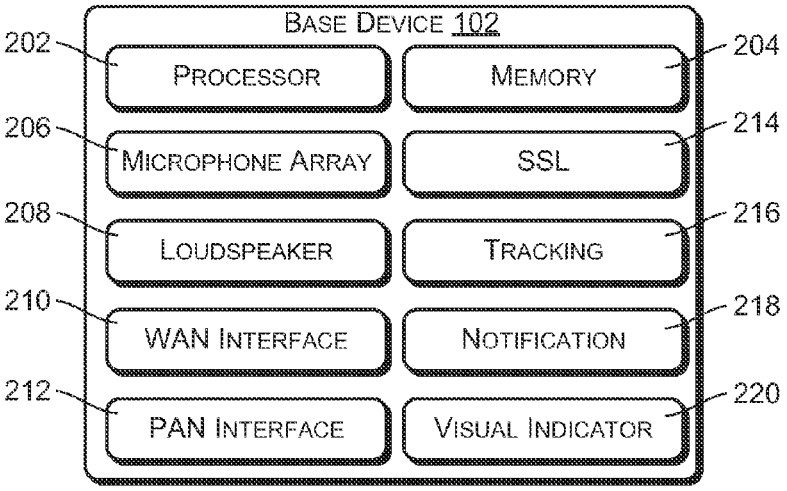
FIG. 2 is a block diagram showing relevant physical and logical components of a base device.

FIG. 2 illustrates relevant components and logical functionality of an example base device 102. The example base device 102 has a processor 202 and memory 204. The processor 202 may include multiple processors, a processor having multiple cores, and or one or more digital signal processors (DSPs). The memory 204 may contain applications and programs in the form of instructions that are executed by the processor 202 to perform acts or actions that implement logical functionality of the base device 102. The memory 204 may be a type of computer storage media and may include volatile and nonvolatile memory. Thus, the memory 204 may include, but is not limited to, RAM, ROM, EEPROM, flash memory, or other memory technology.

The base device 102 may have a microphone array 206 and a loudspeaker 208. The microphone array 206 may have multiple microphones or microphone elements that are spaced from each other for use in sound source localization and/or beamforming. The microphone array 206 may be used to capture audio from the environment of the user 106, including user speech. More specifically, the microphone array 206 may be configured to produce multiple local audio signals containing the speech of the user.

The individual microphones of the array have a fixed spatial arrangement so that the local audio signals may be used for beamforming and sound source localization. In some embodiments, the microphone array may be a two-dimensional array, wherein individual elements of the array are positioned within a single plane. In other embodiments, the microphone may comprise a three-dimensional array, in which individual elements of the array are positioned in multiple planes. Generally, accuracy and resolution of sound source localization may be improved by using higher numbers of microphone elements.

The loudspeaker 208 may be used for producing sound within the user environment, which may include generated or synthesized speech.

The base device 102 may have a wide-area communications interface 210 configured to communicate with the speech-based service 108. The wide-area communications interface 210 may comprise wide-area network (WAN) interface such as an Ethernet or Wi-Fi® interface. The wide-area communications interface 210 may be configured to communicate with the speech-based service 108 through a public network such as the Internet.

The base device 102 may also have a personal-area network (PAN) communications interface 212 such as a Bluetooth® interface or other wireless device-to-device peripheral interface. The PAN interface 212 may be configured to receive a remote audio signal from the remote controller 104, wherein the remote audio signal contains speech utterances of the user 106 as captured by a microphone of the remote controller 104.

The base device 102 may have a sound source localization (SSL) service or functional component 214 that performs SSL to detect the positions of sound sources such as the user 106. The SSL service 214 may utilize time-difference-of-arrival (TDOA) techniques, which may include audio beamforming functionality. Further details regarding SSL will be described below with reference to FIGS. 7 and 8.

The base device 102 may have a tracking component or service 216 that keeps track of the last known location of the remote controller 104. In certain embodiments, the tracking service 216 may utilize position information obtained from the SSL service 214 to determine the position of the user 106 whenever the user 106 speaks into the remote controller 104. The last known position of the user 106 may then be assumed to correspond to the last known location of the remote controller 104. Accordingly, the tracking service 216 may be configured to record or update the last known location of the remote controller 104 whenever the user 106 speaks into the remote controller.

The base device 102 may have a notification component or service 218 configured to indicate the last known location of the remote controller to the user 106. For example, the notification component or service may use voice output to provide verbal instructions to the user 106 regarding the last known location of the remote controller 104. As a more specific example, the user 106 may ask the system 100 for directions to the remote controller 104 and the system 100 may generate speech directing the user 106 toward the remote controller 104. In some implementations, the notification service 218 may repeatedly update the current position of the user based on position information obtained from the SSL service 214 and may use the current position to provide continued instructions to the user 106. For example, the user 106 may make repeated utterances, the SSL component 214 may repeatedly determine the distance of the user from the remote controller 104, and may verbally indicate whether the user 106 is moving closer to or farther from the remote controller 104.

The SSL service 214, the tracking service 216, and/or the notification service 218 may be implemented as programs or instructions stored in the memory 2014 and executed by the processor 202.

The base device 102 may also have a visual directional indicator 220 that is capable of indicating different directions relative to the base device 102. The notification service 218 may use the directional indicator to notify the user 106 regarding where to find the remote controller 104. For example, the notification service 218 may indicate the direction of the remote controller 104 from the base device 102 using the visual indicator 220.

Figure 3:
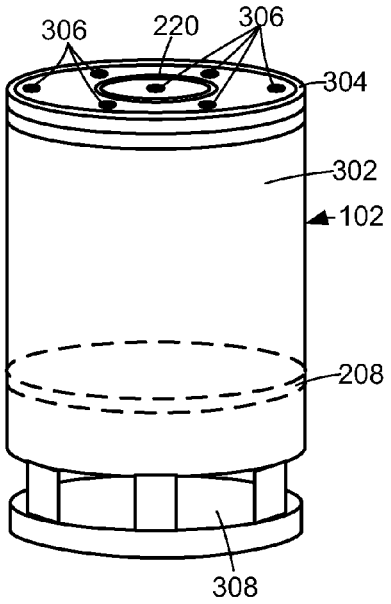
FIG. 3 is a front perspective view of an example base device.
Figure 4:
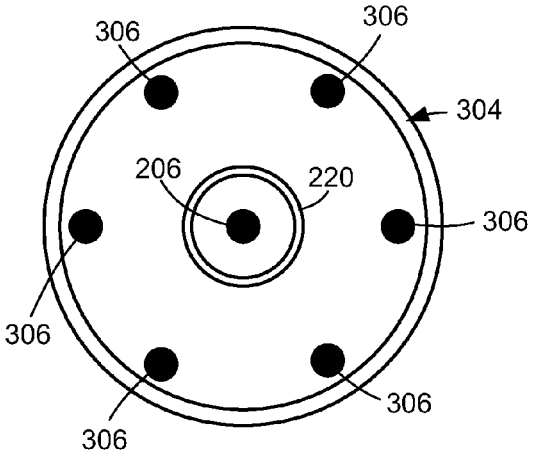
FIG. 4 is a top view of the example base device.
Figure 5:
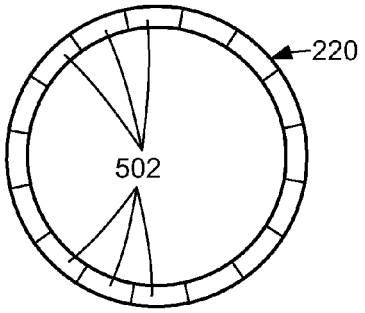
FIG. 5 is a top view of a visual indicator that may be present on the top of the base device.

FIGS. 3-5 show features of an example base device 102. In the illustrated embodiment, the base device 102 comprises a cylindrical housing 302 having a circular top surface 304. The microphone array 206 is formed by multiple local input microphones or microphone elements 306 that are supported by or positioned on the top surface 304. One of the input microphones 306 is positioned at the center of the top surface 304. Other microphones 306 are arranged around the periphery of the top surface 304.

The loudspeaker 208 may be supported or contained by the housing 302. The loudspeaker 208 may be positioned within and toward the bottom of the housing 302, and may be configured to emit sound omnidirectionally, in a 360 degree pattern around the base device 102. For example, the loudspeaker 208 may comprise a round speaker element directed downwardly in the lower part of the housing 302, to radiate sound radially through an omnidirectional opening or gap 308 in the lower part of the housing 302.

The visual indicator 220 may be located on the circular top surface 304 of the housing 302. In the illustrated embodiment, the visual indicator 220 is ring-shaped and has multiple segments that can be individually activated and illuminated in different colors.

FIG. 4 shows the top surface 304 of the base device 102 in more detail. The local microphones 306 are positioned at the center and around the periphery of the circular top surface 304. The visual indicator 220 is positioned concentrically in or on the top surface 304.

FIG. 5 shows further details of the visual indicator 220. In this embodiment, the indicator 220 comprises a plurality of elements or segments 502, each of which can be individually illuminated. In addition, each segment 502 may be capable of displaying different colors, intensities, or temporal patterns. In a particular embodiment, the indicator 220 may have 30 individual segments, each of which may comprise an LED (light-emitting diode) or multi-color LED.

The speech-based service 108 may use the visual indicator 220 in various ways, to indicate various types of information. Animations or patterns may be created by sequentially illuminating individual segments 502 to indicate various conditions or statuses. One or more indicators 502 may also be illuminated using different colors to indicate the different conditions or statuses.

In certain embodiments described herein, individual segments 502 may be used to indicate a direction relative to the base device 102, in order to show the direction of the last known location of the remote controller 104 and to guide the user 106 to the last known location of the remote controller 104. For example, one of the segments 502 or a small arc of the segments 502 may be illuminated in the direction of the last known location of the remote controller 104. Distance from the base device 102 may be indicated by controlling the illumination intensity of the segments 502 or by controlling other visual characteristics of the visual indicator 220.

Figure 6:
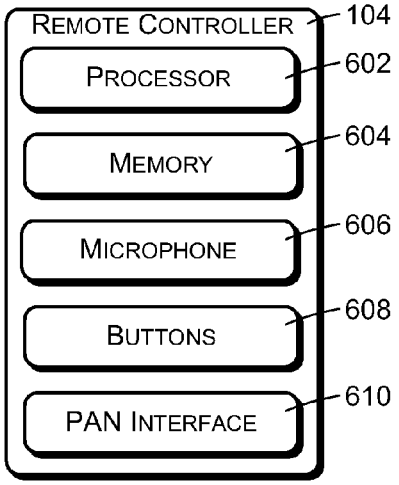
FIG. 6 is a block diagram showing relevant physical and logical components of a remote controller.

FIG. 6 illustrates examples of relevant logical or functional components of the remote controller 104. The remote controller may comprise a processor 602 and memory 604. The memory 604 may contain applications and programs in the form of instructions that are executed by the processor 602 to perform acts or actions that implement logical functionality of the remote controller 104. The memory 604 may be a type of computer storage media and may include volatile and nonvolatile memory. Thus, the memory 604 may include, but is not limited to, RAM, ROM, EEPROM, flash memory, or other memory technology.

The remote controller 104 may have a remote microphone 606 that can be held near the mouth of a user to capture user utterances and speech. The remote microphone generates a remote audio signal that is provided to the base device 102. The remote audio signal contains utterances of the user captured or received by the remote microphone 606.

The remote controller 104 may have one or more buttons or keys 608, such as media control buttons for example. The buttons 608 may include a push-to-talk button that the user presses when speaking into the remote controller 104. The push-to-talk button may be used as an indication that the remote controller is to capture audio using the remote microphone 606 and to stream or otherwise provide the audio to the base device 102.

The remote controller 104 may also have a personal-area network (PAN) interface 610 such as a Bluetooth® interface or other wireless device-to-device peripheral interface. The PAN interface 610 may be configured to provide an audio signal to the base device 102, wherein the received audio signal contains speech utterances of the user 106.

Both the base device 102 and the remote controller 104 may have other components, including other hardware and software components, that are not shown in FIGS. 2-6.

Figure 7:
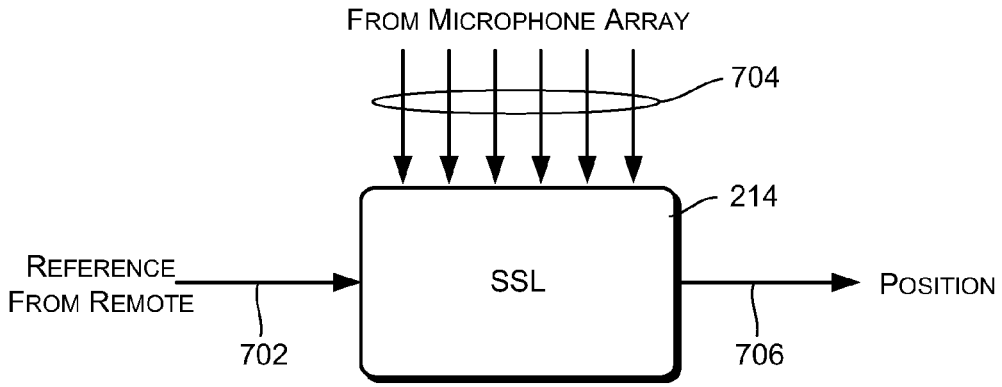
FIG. 7 is a block diagram illustrating sound source localization.

FIG. 7 illustrates an example implementation of sound source localization (SSL), which may be used to determine the position of the user 106 relative to the base device 102. The SSL service 214 receives a remote audio signal 702 from the remote controller 104. The remote audio signal 702 is also referred to for purposes of discussion as a reference audio signal 702. The reference audio signal 702 corresponds to a span of time when the user 106 is speaking into the remote controller 104, and therefore contains a relatively high-quality and low-noise representation of a user utterance.

The SSL service 214 receives a plurality of local microphone signals 704 from the microphone array 206. The SSL service 214 analyzes the local microphone signals 704 based at least in part on the reference audio signal 702 to produce a position signal 706 that indicates the position of the user 106 relative to the base device 102. The position of the user 106 may be indicated in terms of a direction, in terms of a direction and distance, or in terms of 2D or 3D coordinates.

In one embodiment, the reference signal 702 may be compared to each of the microphone signals 704 to determine a time of arrival of a user utterance at each of the microphones elements of the microphone array 206. Differences in the times of arrival may then be analyzed to determine the position of the user 106 or to determine one or more positional coordinates indicative of the user position.

Figure 8:
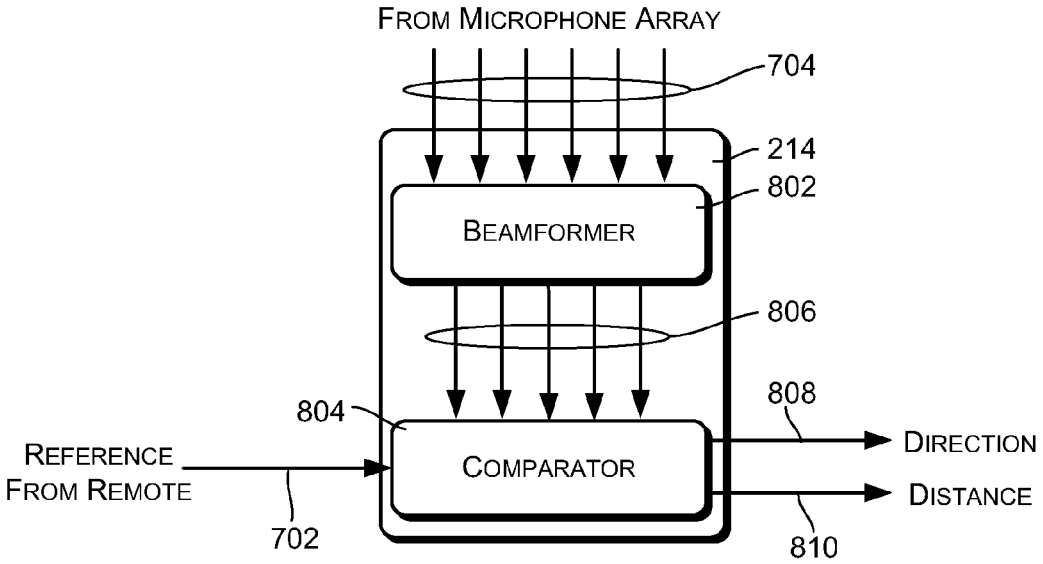
FIG. 8 is a block diagram illustrating sound source localization that uses audio beamforming.

FIG. 8 shows an implementation of sound source localization that uses beamforming. In this implementation, the SSL service 214 is implemented by an audio beamformer 802 and a comparator 804. The audio beamformer 802 receives the local microphone signals 704 from the elements of the microphone array 206 and processes the microphone signals 704 using audio beamforming techniques to produce a plurality of directional audio signals 806, each of which contains or emphasizes sound from a different direction relative to the base device 102.

The comparator 804 receives the directional audio signals 806. The comparator 804 also receives the reference signal 702 from the remote controller 104, wherein the reference signal 702 contains a representation of user speech. The comparator 804 is configured to compare the reference signal 702 to each of the directional audio signals 806 to determine which of the directional audio signals 806 has the strongest presence of the user speech. The directional audio signal 806 having the highest presence of user speech is identified as corresponding to the direction of the user 106 and the direction is output as a direction signal 808. In addition, the comparator 804 may compare the strength or energy of the user speech in the reference signal 702 to the strength or energy of the user speech the identified directional audio signal to determine the distance of the user from the base device 102 and may output a distance signal 810 indicating this distance.

In some embodiments, the comparator 804 or other components may be configured to further analyze the directional audio signals 806 to detect whether user speech within the audio signals is due to reflections rather than to direct acoustic paths, and to reject any such audio signals from consideration by the comparator 804.

Although FIGS. 7 and 8 assume that the reference signal 702 and the microphone signals 704 contain user speech, these signals may alternatively comprise other identifying sounds such as an ultrasonic sound, tone, or "chirp." For example, the remote controller 104 may be configured to periodically emit an identifying sound such as a distinct ultrasonic sound when it is laid down or not in use. The ultrasonic sound may be received by the microphones of the base device 102, which may perform the sound source localization of either FIG. 7 or FIG. 8 based on the presence of the ultrasonic sound in the microphone signals 704 and based on the reference signal 702, which may also contain a representation of the ultrasonic sound. In some implementations, the remote controller 104 may be activated by the base device 102 in certain situations and instructed to begin transmitting the ultrasonic sound. For example, the base device 102 may instruct the remote controller to emit the sound in response to a user indicating that the remote controller has been lost. The base device 102 may determine the position of the remote controller 104 based on the received ultrasonic sound and the reference signal that specifies the ultrasonic sound.

Figure 9:
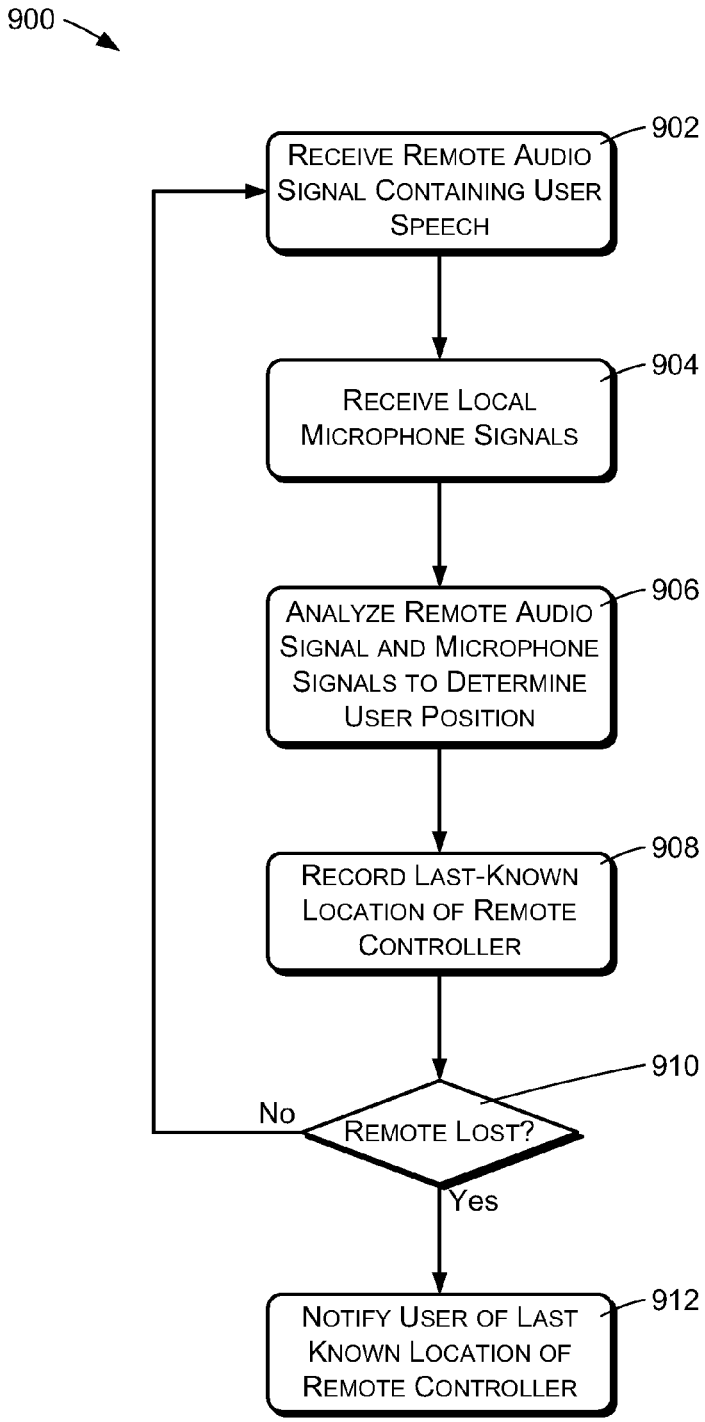
FIG. 9 is a flow diagram illustrating an example method of determining user position and notifying a user of a last known location of a remote controller.

FIG. 9 illustrates an example method 900 that may be performed by the base device 102 in certain embodiments. An action 902 comprises receiving a remote audio signal from a remote controller that is held by a user at a variable position relative to the microphone array of the base device 102. The user speaks into the remote controller, and the remote audio signal contains user speech or utterances. The remote controller may provide the remote audio signal during times when the user presses a push-to-talk button on the remote controller and may be streamed using a networking protocol such as Bluetooth®.

An action 904 comprises receiving a plurality of local microphone signals from the microphone array of the base device. The local microphone signals may contain audio representing sounds from the environment of the user, including user utterances and speech. However, the remote controller is typically held at a much smaller distance from the mouth of the user than the microphones of the microphone array. More specifically, the remote controller may be at a first distance from the user's mouth, while the microphones of the microphone array are at a second, greater distance from the user's mouth. Accordingly, the remote audio signal may have a higher signal-to-noise ratio with respect to user speech than the signals of the microphone array.

An action 906 comprises analyzing the remote audio signal and the microphone signals to determine a position of the user, which may be in terms of one or more positional coordinates corresponding to the position of the user. Various beamforming and SSL techniques may be utilized to determine the positional coordinates as described above. The remote audio signal, which contains a relatively high-quality representation of the user's speech, may be used as a reference to identify user speech in each of the local microphone signals. This information may in turn be used to evaluate differences in arrival times of the user speech at each of the local microphones.

Alternatively, the action 906 may comprise processing the multiple local microphone signals of the microphone array to produce multiple directional audio signals that emphasize sound from different directions, respectively, and comparing the remote audio signal to each of the directional audio signals to determine which directional audio signal has the strongest presence of the user speech.

The determined positional coordinates determined may comprise one or more of a relative position, a direction, a set of one or more Cartesian coordinates, a distance coordinate, and/or other types of coordinates that specify the position of the user in one, two, or three dimensions.

An action 908 may comprise recording one or more positional coordinates as an indication of the last known location of the remote controller.

An action 910 comprises determining when the remote controller has been lost, which may be performed by receiving an indication from the user such as a voice query. For example, the user may ask the system to "find the remote."

If the remote controller is not lost the previously described actions are repeated. Generally, the actions 902, 904, 906, and 908 are repeated for every user utterance, corresponding to each time the user presses the push-to-talk button, speaks into the remote controller, and releases the push-to-talk button. Coordinates indicative of the last known location of the user 106 and of the remote controller 104 are recorded after each user utterance.

If the user indicates that the remote controller has been lost, an action 912 is performed comprising providing information to the user regarding the last known location of the remote controller, based at least in part on the one or more positional coordinates. The action 912 may be performed by verbally directing the user toward the last known location, such as by generating a speech message indicating a direction relative to the current position of the user. In some cases, the user may speak to indicate their current position and the system may respond by telling the user how close they are to the remote controller. The system may continue to notify the user that they are getting closer or farther as the user moves. As another example, the system may identify the last known location with reference to landmarks or features of a room within which the system is located, such as furniture, appliances, other electronic devices, geometric features of the room, and so forth.

In other embodiments, a visual indicator may be used to indicate the last known location of the remote controller. For example, the visual indicator 220 may be controlled to indicate a radial direction corresponding to the direction of the last known location of the remote controller.

Although the subject matter has been described in language specific to structural features, it is to be understood that the subject matter defined in the appended claims is not necessarily limited to the specific features described. Rather, the specific features are disclosed as illustrative forms of implementing the claims.

The invention claimed is:

1. A device comprising:

a communications interface configured to receive a remote audio signal from a remote controller that is held and spoken into by a user, wherein the remote audio signal represents speech of the user;

an array of microphones configured to produce multiple local audio signals representing the speech of the user, wherein the microphones of the array have a fixed spatial arrangement within the device, and wherein the remote controller is at a variable position relative to the device;

a sound source localization service configured to analyze the local audio signals and the remote audio signal to determine one or more positional coordinates corresponding to a position of the user relative to the device when the user speaks into the remote controller;

a tracking service configured to record the one or more positional coordinates as an indication of a last determined location of the remote controller relative to the device; and a notification service configured to provide information to the user regarding the last determined location of the remote controller based at least in part on the one or more positional coordinates.

2. The device of claim 1, wherein the one or more positional coordinates comprise one or more of:

a direction coordinate;

a distance coordinate; or a Cartesian coordinate.

3. The device of claim 1, wherein the notification service is configured to provide the information regarding the last determined location of the remote controller by verbally guiding the user.

4. The device of claim 1, further comprising a visual indicator capable of indicating different directions, wherein the notification service is configured to provide the information regarding the last determined location of the remote controller by visually indicating one of the different directions with the visual indicator.

5. The device of claim 1, wherein the sound source localization service comprises an audio beamformer that is configured to perform actions comprising:

processing the local audio signals to produce multiple directional audio signals that emphasize sound from different directions, respectively; and comparing the remote audio signal to each of the directional audio signals to determine which directional audio signal has the strongest presence of the speech of the user.

6. The device of claim 1, wherein the sound source localization service is further configured to compare a strength of the speech of the user at the remote controller to a strength of the speech of the user at the device to determine a distance of the remote controller from the device.

7. A method, comprising:

receiving, at a device, a remote audio signal from a remote controller that is held and spoken into by a user, wherein the remote audio signal represents speech of the user;

receiving one or more local microphone audio signals from an array of microphones on the device, the one or more local microphone audio signals represent the speech of the user;

analyzing the one or more local microphone audio signals based at least in part on the remote audio signal to determine a position of the user relative to the device;

recording the determined position of the user as a last determined location of the remote controller relative to the device; and notifying the user regarding the last determined location of the remote controller.

8. The method of claim 7, wherein determining the position of the user comprises determining one or more of:

a direction coordinate;

a distance coordinate; or a Cartesian coordinate.

9. The method of claim 7, wherein the remote audio signal is received using a Bluetooth interface.

10. The method of claim 7, wherein the analyzing comprises performing audio beamforming.

11. The method of claim 7, wherein the analyzing comprises comparing a first strength of the speech of the user in the remote audio signal to a second strength of the speech of the user in the one or more local microphone audio signals.

12. The method of claim 7, wherein the notifying comprises verbally guiding the user.

13. The method of claim 7, wherein the notifying comprises visually guiding the user.

14. The method of claim 7, wherein the notifying comprises identifying landmarks that are near the last known location of the remote controller.

15. The method of claim 7, wherein the one or more local microphone audio signals are produced by microphones at different microphone locations in the array; and wherein analyzing the one or more microphone audio signals comprises:

identifying the speech of the user in each of the one or more microphone audio signals based at least in part on the remote audio signal; and evaluating differences in arrival times of the speech of the user at each of the microphones based at least in part on the identified speech of the user in the one or more microphone audio signals.

16. The method of claim 7, wherein analyzing the one or more microphone audio signals comprises:

processing the one or more microphone audio signals to produce multiple directional signals that emphasize sound originating from different directions, respectively; and comparing the remote audio signal to each of the directional audio signals to determine which directional audio signal has the strongest presence of the speech of the user.

17. The method of claim 7, wherein:

the remote controller is held at a first distance from a mouth of the user;

the one or more microphone audio signals are received from one or more microphones that are at least a second distance from the mouth of the user; and the second distance is greater than the first distance.

18. A method comprising:

receiving, by a device within an environment, a reference audio signal from a handheld device;

receiving one or more microphone audio signals that contain audio from a source proximate to the handheld device, wherein the one or more microphone audio signals are received from an array of microphones having a fixed spatial arrangement within the device; and performing sound source localization on the one or more microphone audio signals based at least in part on the reference audio signal to determine a position of the handheld device within the environment.

19. The method of claim 18, wherein the reference audio signal corresponds to an identifying sound that is emitted by the handheld device and the audio from a source proximate to the handheld device comprises audio emitted by the handheld device.

20. The method of claim 18, wherein determining the position of the handheld device comprises determining one or more one or more of:

a direction coordinate;

a distance coordinate; or a Cartesian coordinate.

21. The method of claim 18, wherein performing the sound source localization comprises:

identifying user speech in each of the one or more microphone audio signals based at least in part on the reference audio signal; and evaluating differences in arrival times of the user speech at each of the microphones in the array of microphones based at least in part on the identified user speech in the one or more microphone audio signals.

22. The method of claim 18, wherein performing the sound source localization comprises:

processing the one or more microphone audio signals to produce multiple directional signals that emphasize sound originating from different directions, respectively; and comparing the reference audio signal to each of the directional audio signals to determine which directional audio signal has the strongest presence of the audio.

23. The method of claim 18, wherein:

the handheld device is held at a first distance from a mouth of a user;

the one or more microphones are at least a second distance from the mouth of the user; and the second distance is greater than the first distance.

* * * * *